US007188373B2

(12) United States Patent
Jaunault et al.

(10) Patent No.: US 7,188,373 B2
(45) Date of Patent: Mar. 13, 2007

(54) FASTENING DEVICES FOR CHAIN MAIL PROTECTIVE GLOVES

(75) Inventors: Philippe Jaunault, Villemoisan (FR); Sophie Jaunault, Villemoisan (FR)

(73) Assignee: Manulatex France Z.A. du Mille, Champtoce sur Loire (FR)

( * ) Notice: Subject to any disclaimer, the term of this patent is extended or adjusted under 35 U.S.C. 154(b) by 233 days.

(21) Appl. No.: 10/380,067

(22) PCT Filed: Sep. 11, 2001

(86) PCT No.: PCT/FR01/02823

§ 371 (c)(1),
(2), (4) Date: Sep. 3, 2003

(87) PCT Pub. No.: WO02/21952

PCT Pub. Date: Mar. 21, 2002

(65) Prior Publication Data

US 2004/0025223 A1 Feb. 12, 2004

(30) Foreign Application Priority Data

Sep. 12, 2000 (FR) ..... 00/11749

(51) Int. Cl.
*A41D 19/00* (2006.01)

(52) U.S. Cl. ..... 2/161.6

(58) Field of Classification Search ..... 2/16, 2/20, 158–160, 161.6, 162
See application file for complete search history.

(56) References Cited

U.S. PATENT DOCUMENTS

| | | | | |
|---|---|---|---|---|
| 4,471,495 | A | 9/1984 | Kruse et al. | |
| 5,088,123 | A * | 2/1992 | MacDonald | 2/162 |
| 5,511,241 | A * | 4/1996 | Ziegler | 2/2.5 |
| 5,729,831 | A * | 3/1998 | Kuhlmann | 2/16 |
| 5,862,521 | A * | 1/1999 | van Marwijk et al. | 2/16 |
| 5,894,602 | A * | 4/1999 | Smith et al. | 2/159 |
| 6,076,190 | A * | 6/2000 | Besson | 2/161.6 |
| 6,438,759 | B1 * | 8/2002 | Jaunault et al. | 2/167 |
| 6,457,182 | B1 * | 10/2002 | Szczesuil et al. | 2/161.6 |

* cited by examiner

*Primary Examiner*—Gary L. Welch
(74) *Attorney, Agent, or Firm*—Young & Thompson

(57) ABSTRACT

A mail chain protective glove consisting of a part designed to cover the hand, extended by a full sleeve-like part devoid of lateral slot, designed to be urged to cover part of the wrist zone, which wrist portion is extended optionally by a cuff protecting the forearm or the arm, likewise in the shape of a full sleeve devoid of lateral slot. The glove provided with a fastening system on the portion covering the wrist and/or the protective cuff. The binding system consists of a hook member which co-operates with at least an orifice provided in a catching structure, which hook member is provided with a projecting element which forms a gripping element facilitating the fastening manoeuvre on the receiving structure as well as the unfastening manoeuvre.

21 Claims, 6 Drawing Sheets

FASTENING DEVICES FOR CHAIN MAIL PROTECTIVE GLOVES

BACKGROUND OF THE INVENTION

This invention concerns gloves made of coat of mail used notably in the meat industry to protect the hand and possibly the forearm or the arm of people using cutting or sharp tools.

These gloves are composed of a latticework of interlaced metallic rings and they generally comprise a clamping system at the wrist for easier handability. Certain models are equipped with an extension forming a collar covering a portion of the user's arm, or the whole arm. When this collar is made of coat of mail, longitudinal stiffening members maintain its tension, and a clamping system may be provided at its end.

For safety reasons, it is preferable that the wrist zone made of a coat of mail fabric, or that the collar made of a coat of mail fabric, should form a complete sleeve deprived of any lateral slots.

There is a very large number of clamping systems enabling to hold the glove on the hand.

Some of these clamping systems have a complex structure or are not easy to be used.

Others, of relatively simple structure, do not keep their clamping characteristics with the course of time; it is the case in particular of the metallic clamping systems with resilient structure (spiral wound spring or helicoids spring) which may slacken with the passing of time.

Some others still of these clamping systems raise cleaning problems, either because of their complex structure, or because they use clamping straps and/or stiffening members of plastic material with poor resistance to bleaches or high temperatures.

It will also be noted that certain gloves comprise hooking members designed to be hooked in the coat of mail fabric for easier clamping. However, it may happen that these hooking members grip inadvertently the coat of mail fabric of the glove, or of other gloves, in particular within the framework of the cleaning operations of the gloves, and it is not always very easy to perform the necessary releasing and disconnection operations.

This invention intends to remedy these shortcomings.

SUMMARY OF THE INVENTION

The glove made of coat of mail according to this invention is of the type composed of a first portion intended to cover the hand, extended by a second portion in the form of a complete sleeve deprived of any lateral slots, intended to cover the wrist zone, which second portion may be extended by a collar for protecting the forearm or the arm, also in the form of a complete sleeve deprived of any lateral slots; it is also fitted with a clamping system on the portion covering the wrist and/or on the protection collar.

This glove is characterised in that its clamping system is composed of a hooking member which co-operates with at least one orifice provided in a gripping structure, which hooking member is fitted with a protruding element which constitutes a prehensile means facilitating the hooking operations on the receiving structure, as well as the releasing operations.

This clamping device structure is very simple to be realised; moreover it proves very efficient and safe during operation.

Still according to the invention, the hooking member is fitted with a plane end return whereof the length I is greater than the internal diameter of the rings of the coat of mail fabric of the glove.

On the other hand, this hooking member is advantageously realised by cutting and embossing/folding a metal sheet.

According to a first possible embodiment, the hooking member is in the form of plane structure fitted with a plane end return which constitutes the hook co-operating with the or one of the orifices of the gripping structure, the protruding element of said hooking member being in the form of a transversal edge provided from the upper face of said plane structure.

This transversal edge extends preferably on a plane tilted with respect to the plane perpendicular to the upper face of the plane structure, for easier hooking or releasing operations.

According to another possible embodiment, the hooking member is in the form of a plane structure fitted with a plane end return which constitutes the hook cooperating with the or one of the orifices of the gripping structure, the protruding element of said hooking member being in the form of a boss provided from the upper face of said plane structure, fitted with a face or a transversal edge for easier handability.

According to another particularity, the plane end return which constitutes the hook of the hooking member comprises lateral edges slightly chamfered, convergent, which confer substantially trapezoid shape thereto for easier insertion and disengagement in the orifice(s) of the gripping structure.

According to a first possible embodiment, the gripping structure is in the form of added-on ring(s), imbedded in the coat of mail fabric. This or these rings may be generally rectangular, oval, circular in shape or other.

According to another possible embodiment, the gripping structure is in the form of a plate fitted with a plurality of orifices, to enable adjustment of the clamping tension. This plate is advantageously cambered to follow the contour of the user's wrist or arm.

According to still another possible embodiment, the gripping structure is in the form of several plates juxtaposed or which overlap each other partially, each including at least one orifice, to enable adjustment of the clamping tension.

In a particularly interesting embodiment, the clamping system of the glove contains—a gripping plate, or several associated plates, fitted with one or several oblong orifices arranged parallel to one another, and—a hooking member whereof the end hook is active over the whole length or substantially the whole length of said orifice or of said orifices.

According to a first possible embodiment, the clamping system contains a gripping structure attached to the coat of mail fabric, and a hooking member whereof the rear end is also attached to the coat of mail fabric, some distance away from said gripping structure for easier clamping on the corresponding glove zone.

According to another embodiment, the rear end of the hooking member is attached to the coat of mail fabric by means of one or of several inserts connected to one another.

According to still another embodiment, the clamping system is composed of a single-piece strip hugging the corresponding glove zone; one of the ends of this strip is formed to provide the hooking member, and its other end is formed to provide the gripping structure.

This strip can be maintained on the corresponding glove zone by means of one or of several loops made of coat of mail, or by means of one sleeve made of coat of mail.

According to still another possible embodiment, the clamping system is composed of a hooking member and of a gripping structure attached to the ends of an added-on strap, which strap is in the form of a strip or of a series of inserts. Here again, a system of loop(s) or of sleeve made of coat of mail can be used to maintain the strap on the corresponding glove zone.

To improve the clamping characteristics, an additional plate may be attached at the end of the gripping structure by a hinged link; this additional plate is housed in the sleeve which receives the strap in the form of a strip or a series of inserts.

According to a preferred embodiment, the receiving sleeve of the strap extends from each of the ends of the gripping structure, and it comprises an exit slot for the end of said strap fitted with the hooking member.

BRIEF DESCRIPTION OF THE DRAWINGS

But the invention will be better illustrated, without being limited thereto, by the following description of several particular embodiments, given solely for exemplification purposes and represented on the appended drawings wherein.

DETAILED DESCRIPTION OF THE PREFERRED EMBODIMENTS

Figure 1:
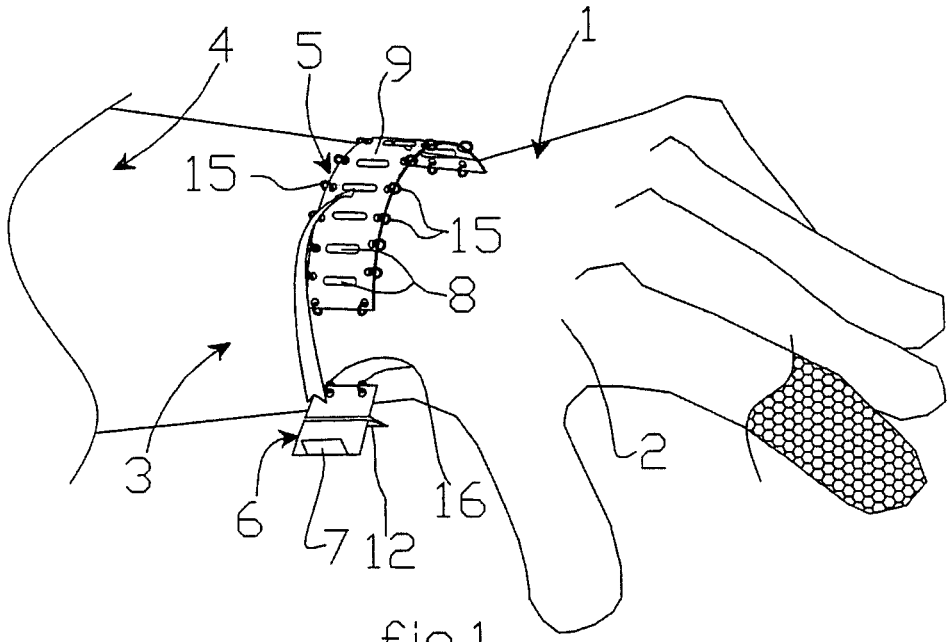
FIG. 1 is a perspective view of a glove made of coat of mail whereof the wrist portion is equipped with a possible embodiment of a clamping device according to this invention, such clamping device being represented here de-activated.
Figure 2:
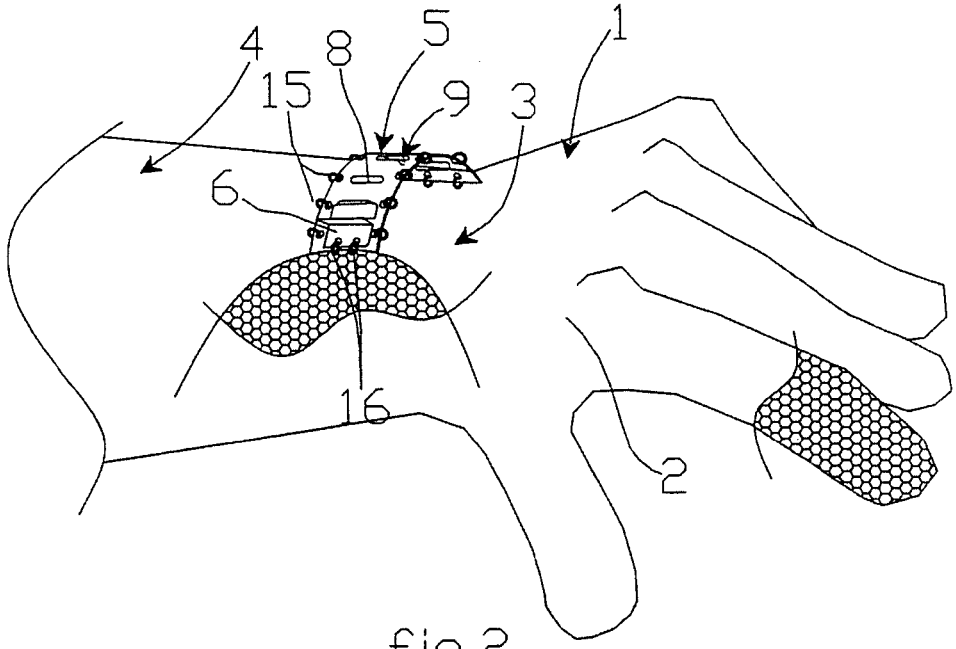
FIG. 2 shows the glove of FIG. 1 with the clamping device in action.

The glove 1 illustrated on FIGS. 1 and 2 is made of coat of mail fabric, i.e. it is composed of a latticework of interlaced metallic rings. The corresponding rings can be made of stainless steel wire of 0.5 or 0.55 mm in diameter; their internal diameter may be of the order of 2 to 4 mm.

Such glove 1 contains a hand portion 2 extended by a portion 3 in the form of a complete cylindrical sleeve, i.e. deprived of any lateral slots, which is intended to cover the user's wrist. Such portion 3 is prolonged itself by an extension 4, represented partially, forming a collar for protecting the forearm or the arm; this protection collar 4 is also in the form of complete cylindrical sleeve, deprived of any lateral slots.

The three portions of glove 2, 3 and 4 are single pieces made of coat of mail fabric.

The cylindrical portion 3 of the wrist zone is equipped with a clamping system 5 composed of a hooking member 6 fitted with an end hook 7 which cooperates with one of the orifices 8 of an added-on gripping structure 9, here in the form of a plate.

Figure 3:
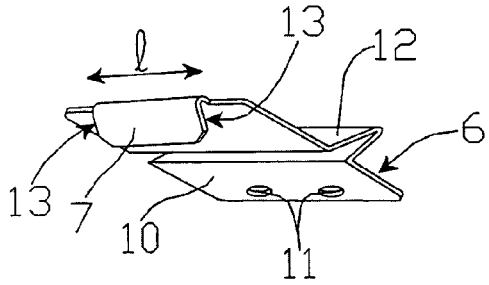
FIG. 3 is a perspective view of the gripping member of the clamping device illustrated on FIGS. 1 and 2.
Figure 4:
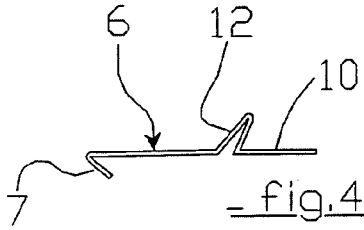
FIG. 4 is a side view of the gripping member illustrated on FIG. 3.

The hooking member 6 is detailed on FIGS. 3 and 4. It is in the general shape of a plane structure 10 in the form of an insert whereof the front end comprises a plane return, slightly inward, making up the hook 7, and whereof the rear end is equipped with orifices 11, here two in number, to be fastened to the coat of mail fabric.

A transversal edge 12 protrudes from the upper face of the plane structure 10 for easier hooking and releasing operations. This transversal edge 12 extends on a plane slightly tilted with respect to the plane perpendicular to the upper face of the insert 10 for easier handability.

The end return 7 and the transversal edge 12 are each provided on one side of the plane structure 10 of the hooking member 8, and both of them are slightly tilted in the same direction, such direction being opposite the traction direction necessary to closing the clamping device.

The hooking member 6 illustrated on FIGS. 1 to 4 is made by cutting and folding a metal sheet, for instance a stainless steel sheet of 0.7 mm thickness; its width may be of the order of 1.5 to 2.5 cm, and the end hook 7 may extend over a length l corresponding approximately to half or ⅔ of this width. The hook 7 is centered on the width of the gripping member 6. The transversal edge 12 extends over the whole width of the hooking member 6; it is obtained by folding the metallic sheet into a V-shape.

As can be seen on FIG. 3, the lateral edges 13 of the hook 7 are slightly chamfered or slanted for easier hooking operations and especially releasing operations on the orifice(s) 8 of the gripping structure 9. Both these convergent edges 13 confer general trapezoid shape to the hook 7. The corresponding chamfering is of the order of a few degrees.

The depth of the hook 7 is adapted for better gripping on the orifice(s) 8 of the gripping structure 9; this depth may be of the order of 4 to 5 mm.

The general sizes of the hook 7 are adapted to prevent any direct gripping on the rings of the coat of mail fabric. In particular, the length l of the hook 7 is greater than the internal diameter of the rings used to make the structure of coat of mail of the glove.

Figure 5:
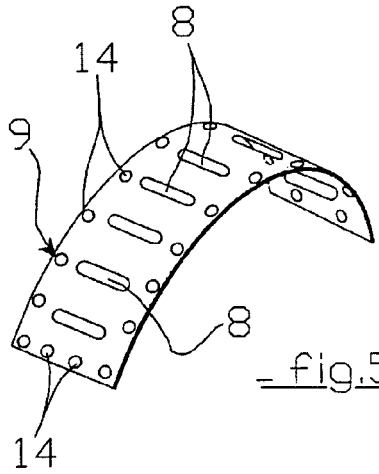
FIG. 5 is a perspective view of the gripping plate of the clamping device illustrated on FIGS. 1 and 2.

The gripping plate 9 is detailed on FIG. 5. This plate 9, generally rectangular in shape, can also be cut into a metallic sheet (for example a stainless steel sheet of 0.7 mm in thickness). Its width may be of the order of 1.5 to 2.5 cm, and its length may be of the order of a few centimetres. This plate 9 is slightly cambered the better to hug the contour of the user's wrist.

The orifices 8 designed to co-operate with the hook 7 of the hooking member 6 are spaced regularly parallel to one another over the length of the plate 9; these orifices 8 have an oblong shape whereof the length corresponds, including the clearance, to the length I of the upper portion of the hook 7; their width is slightly greater than the thickness of said hook 7.

The number and the position of the oblong orifices 8 depend on the clamping possibilities that one wishes to obtain.

On the periphery of the plate 9, one may note the presence of circular orifices 14 intended for fastening said plate to the coat of mail fabric.

As can be seen on FIGS. 1 and 2, the gripping plate 9 is attached to the coat of mail fabric of the wrist zone 3 by means of metallic rings 15 (for instance of the rings identical or similar to those used for the manufacture of the glove). The rings 15 engage into certain rings of the coat of mail fabric, and they go through the orifices 14 aforementioned of the plate 9.

The plate 9 is thus practically pressed against the coat of mail fabric, over a portion of the periphery of the wrist. One will observe that the presence of the orifices 8 and 14 improves the flexibility of the plate 9 which may also hug the contour of the wrist ideally.

The hooking member 6 is also attached to the wrist zone 3, at a little distance from the gripping plate 9, by means of fastening metallic rings 16. Here again, these rings 16 can be identical or similar to those used for the manufacture of the glove.

The rings 16 engage into certain rings of the coat of mail fabric, and they go through the end orifices 11 of the hooking member 6. This hooking member is then somehow hinged on the coat of mail fabric of the glove, its front end fitted with the hook 7 being free.

It will be noted here that in an embodiment variation, the hooking member may be attached to the coat of mail fabric of the glove by means of a metallic insert, or of several inserts hinged to one another.

As the user has inserted his hand in the glove 1, the wrist zone can be clamped very simply as illustrated on FIG. 1, by pulling on the hooking member 6 in order to insert its end hook 7 into one of the orifices 8 of the plate 9. This operation is facilitated by the presence of the protruding edge 12. The selection of the orifice 8 used depends on the clamping characteristics desired.

The activated clamping device is represented on FIG. 2.

The corresponding clamping operation, performed by means of a hooking member which is locked removably on an orifice especially provided in a gripping structure, is very easy to carry out. Such clamping is moreover of excellent quality.

Slight tilting of the hook 7 enables better gripping on the plate 9. On the other hand, the use of a plane hook 7 active over the whole length or substantially the whole length of the oblong receiving orifice 8 enables to improve the interconnection of the gripping member on the gripping plate.

Figure 6:
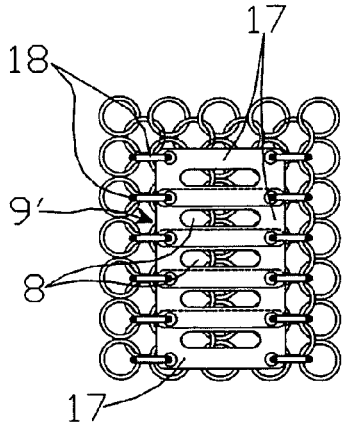
FIG. 6 illustrates a possible variation of the gripping structure, here in the form of a plurality of inserts partially superimposed, and attached to the coat of mail fabric.
Figure 7:
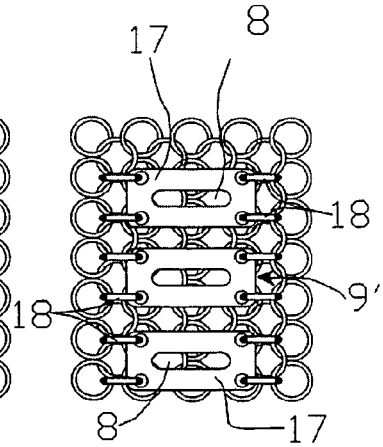
FIG. 7 illustrates still a possible variation of the gripping structure, here composed of a plurality of inserts simply juxtaposed.

Another possible embodiment of the gripping structure is illustrated on FIGS. 6 and 7.

On FIG. 6, the gripping structure 9' is composed of a plurality of independent inserts 17 partially superimposed and attached to the coat of mail fabric by means of junction rings 18. Each insert 17 comprises an orifice 8 enabling to imbed the hook 7 of the hooking member 6. Similarly, each insert might comprise two parallel orifices 8, let alone more of them.

On FIG. 7, the inserts 17 are also attached to the coat of mail fabric by means of junction rings 18, but the inserts 17 are here simply juxtaposed (they do not superimpose one another).

Here again, each insert 17 might comprise more than one orifice 8.

Figure 8:
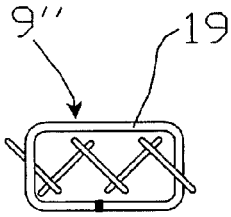
FIG. 8 illustrates still a possible variation of the gripping structure, in the form of a rectangular ring imbedded in the coat of mail fabric.
Figure 9:
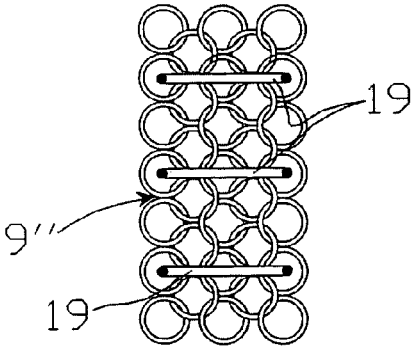
FIG. 9 is a bottom view which shows the association of three rectangular rings according to FIG. 8, attached to the coat of mail fabric for better adjustment of the clamping tension.

FIGS. 8 and 9 illustrate still another possible variation of gripping structure.

This gripping structure 9" is composed of at least one independent ring 19 imbedded in the coat of mail fabric as illustrated on FIG. 8.

As can be seen as a bottom view on FIG. 9, several rings 19 can be used, spaced regularly, for easier adjustment of the clamping.

The ring(s) 19 are advantageously made of metallic wire; they are advantageously imbedded in the coat of mail fabric before being closed by a welding spot. They protrude beyond the coat of mail fabric for easier gripping of the hook 7 of the hooking member 6. They can advantageously protrude on either side of the coat of mail fabric to obtain an ambidextrous reversible glove. The hooking member, and in particular its fastening to the glove should then be adapted consequently.

Figure 10:
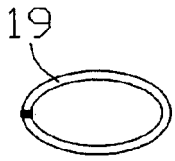
FIGS. 10 and 11 shows two other possible embodiments of the gripping ring(s)
Figure 11:
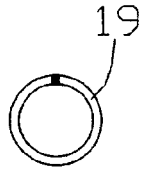

As illustrated on FIGS. 8 and 9, the gripping rings 19 can have a rectangular contour. They can be in other forms, for instance oval (FIG. 10) or circular (FIG. 11).

Figure 12:
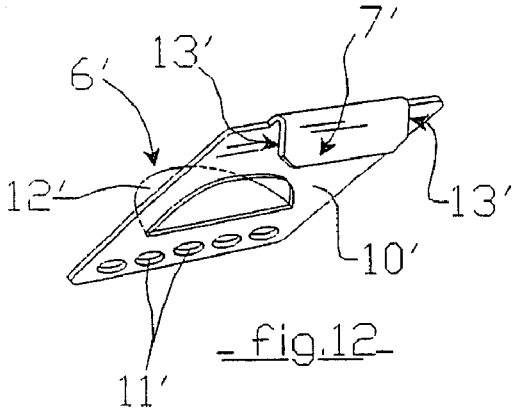
FIG. 12 is a perspective view which illustrates a possible variation of the hooking member, seen from below.
Figure 13:
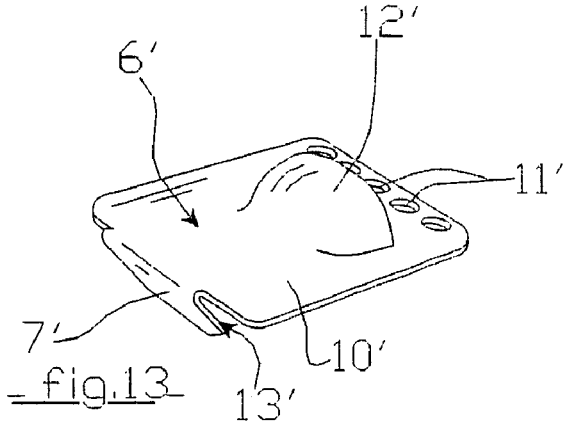
FIG. 13 shows the hooking member of FIG. 12, seen from below.

FIGS. 12 and 13 illustrate a possible variation of the hooking member.

Such hooking member 6' is composed of a plane structure 10' in the form of insert whereof the front end is fitted with the hook 7' and whereof the rear end comprises fastening orifices 11'. A protruding element 12' is provided from the upper face of the insert 10' to provide the prehensile means facilitating the hooking operations on the receiving structure, as well as the releasing operations. Such protruding element 12' is in the form of a boss made by embossing after transversal cutting. Such a boss delineates a transversal edge towards the rear for easier manipulation by means of one or several fingers.

Figure 15:
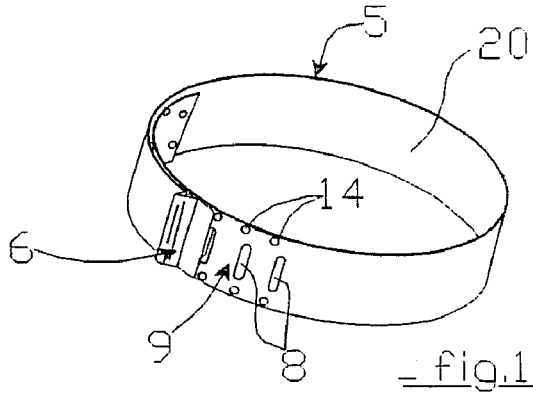
FIG. 15 is an isolated view of the clamping device used on the glove of FIG. 14.
Figure 14:
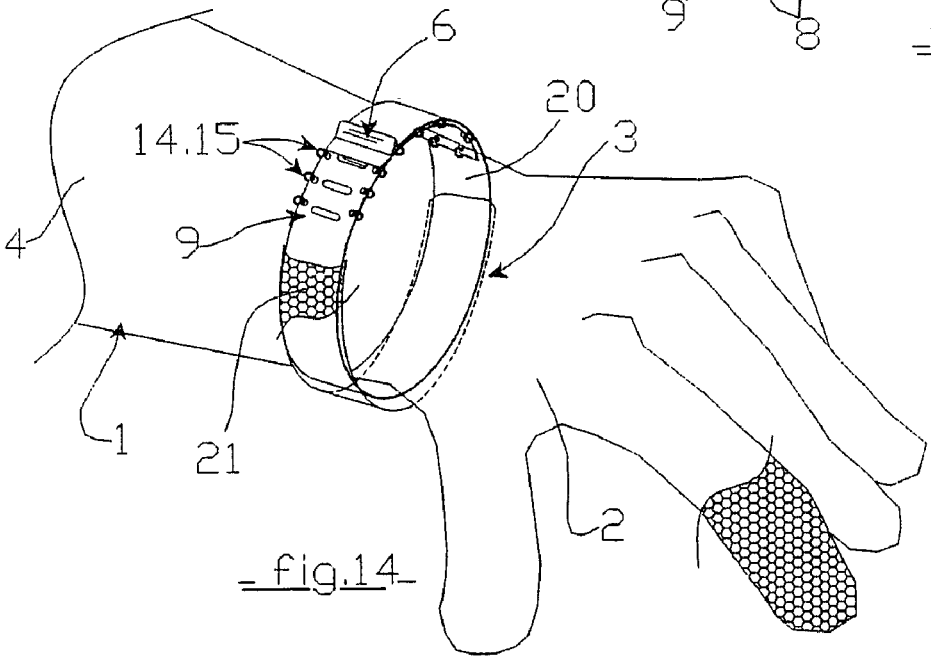
FIG. 14 is a perspective view of a glove made of coat of mail whereof the wrist portion is equipped with another possible embodiment of a clamping device according to this invention.

FIGS. 14 and 15 illustrate another possible embodiment of the clamping device 5 according to this invention.

In this embodiment variation, the hooking member 6 and the gripping plate 9 have a structure identical or similar to that which has just been described in relation to FIGS. 1 to 5, but both elements are formed at the ends of a strip 20 which forms a kind of strap and which hugs the wrist zone.

The strip 20 may consist of a metallic band, for instance a steel band of 1.5 cm in width and of 0.2 mm in thickness, whereof the ends are folded and cut conveniently.

The single-piece clamping device illustrated on FIGS. 14 and 15 can be obtained.

Such clamping device has a general circular shape; as illustrated on FIG. 14, it may be housed in a sleeve 21 provided on the glove 1, on a portion of the periphery of the twist zone.

The receiving sleeve 21 is advantageously made of coat of mail, for instance by means of a band, added-on and attached to the wrist zone by means of metallic sewing rings.

It is preferably provided over the whole periphery of the wrist, except on the gripping plate 9, for easier clamping.

As a variation, the sleeve 21 may be replaced with simples loops made of coat of mail.

For correct and permanent positioning of the clamping device 5, the plate 9 is attached to the coat of mail fabric of the glove by means of metallic rings 15 which go through the circular orifices 14, similarly to the previous embodiment.

Figure 16:
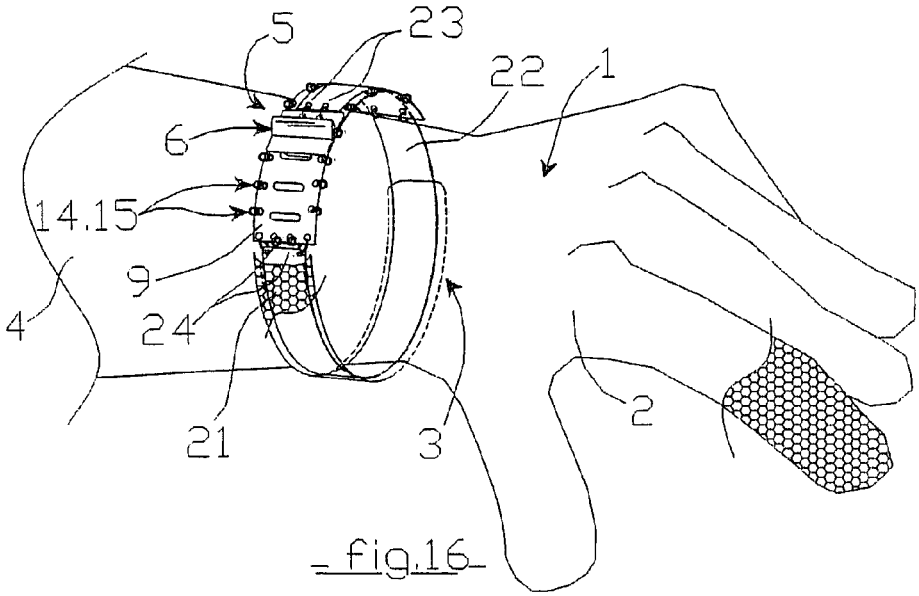
FIG. 16 is a perspective view of a glove made of coat of mail whereof the wrist portion is equipped with another possible embodiment of the clamping device according to this invention.
Figure 17:
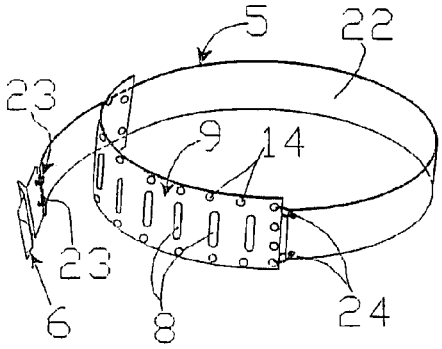
FIG. 17 is an isolated view of the clamping device used on the glove of FIG. 16, such clamping device being here represented in deactivated condition.
Figure 18:
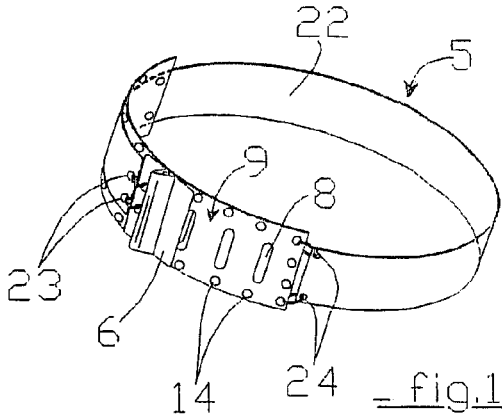
FIG. 18 shows the clamping device of FIG. 17 in activated condition.

FIGS. 16 to 18 illustrate another embodiment in which the clamping device S is composed of a hooking member 6 and of a gripping plate 9 as illustrated on FIGS. 1 to 5, linked at one of their ends by an added-on strip 22 which forms a kind of strap.

The rear end of the gripping member 6 is attached to one of the ends of the strip 22 by the linking rings 23; and the rear end of the plate 9 is attached to the other end of the strip 22 by the linking rings 24.

The gripping member 6 and the gripping plate 9 can be made of a stainless steel sheet of 0.7 mm in thickness to confer suitable resistance thereto, whereas the strip 22 may be made of stainless steel sheet of 0.2 mm in thickness to confer good flexibility thereto.

A circular clamping device similar to that illustrated on FIGS. 14 and 15 can be obtained. On FIG. 17, such clamping device is represented as isolated and in loosened position; on FIG. 18, it is represented in activated position.

As represented on FIG. 16, the strip 22 may be housed in a sleeve of coat of mail 21 provided on the wrist zone of the glove, such sleeve 21 extending substantially from the ends of the gripping plate 9. Here again, this plate 9 is preferably attached to the coat of mail fabric by means of metallic rings 15 which go through the circular orifices 14.

As for the previous embodiment, the sleeve 21 may be replaced with the loops made of coat of mail.

Handling the gripping member 6 is very easy because of its interconnection with the strip 22 by means of the junction rings 23 which provide a hinged link. On the side of the gripping member 6, the sleeve 21 stops at some distance from the plate 9 for easier clamping and releasing operations.

Figure 19:
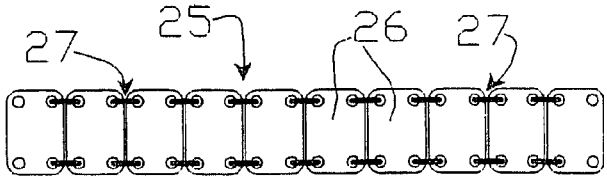
FIG. 19 illustrates a association of metallic inserts formant a strap capable of replacing the strip of the embodiments of the FIGS. 16 to 18.
Figure 20:
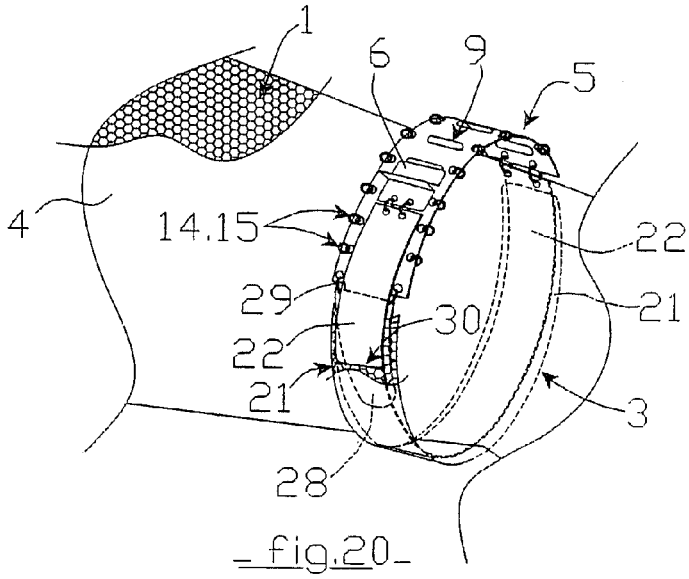
FIG. 20 is a perspective view of a portion of glove made of coat of mail whereof the wrist zone is still equipped with another possible embodiment of the clamping device according to this invention.

As a variation, the strip 22 may be replaced with a strap 25 composed of an assembly of metallic inserts 26, assembled by means of linking rings 27, as illustrated on FIG. 19.

FIGS. 20 to 24 show an embodiment derived from the one illustrated on FIGS. 16 to 19. Here, the end of the gripping plate 9 which is not linked with the strip 22 is extended by an additional plate 28 connected by junction rings 29.

Such additional plate 28 may be made of a stainless steel sheet of 0.2 mm in thickness; its width corresponds substantially to that of the strip 22 and it extends over a length of a few centimetres.

Figure 21:
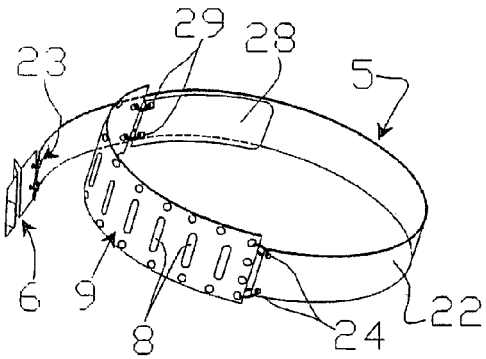
FIG. 21 is an isolated view of the clamping device used on the glove of FIG. 20, such clamping device being here represented de-activated.
Figure 22:
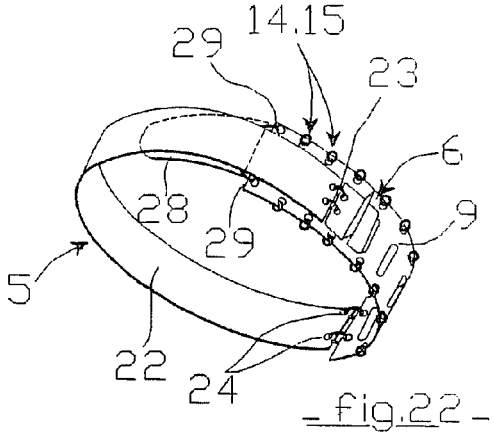
FIG. 22 shows the clamping device of FIG. 21 in activated position.

The clamping device obtained is illustrated individually on FIG. 21 in released position, and in active position on FIG. 22.

The additional plate 28 is intended to be housed in the sleeve 21 provided on the periphery of the wrist zone. Its presence enables good distribution of the coat of mail fabric on the periphery of the wrist during the clamping operation.

The sleeve 21 starts as close as possible at the end of the gripping plate 9 to optimise this distribution of the coat of mail; to have sufficient elbow room when handling the hooking member, the end of the strip 22 which carries said hooking member comes out of the sleeve 21 by a slot 30 provided a few centimeters away from the end of said sleeve.

Figure 23:
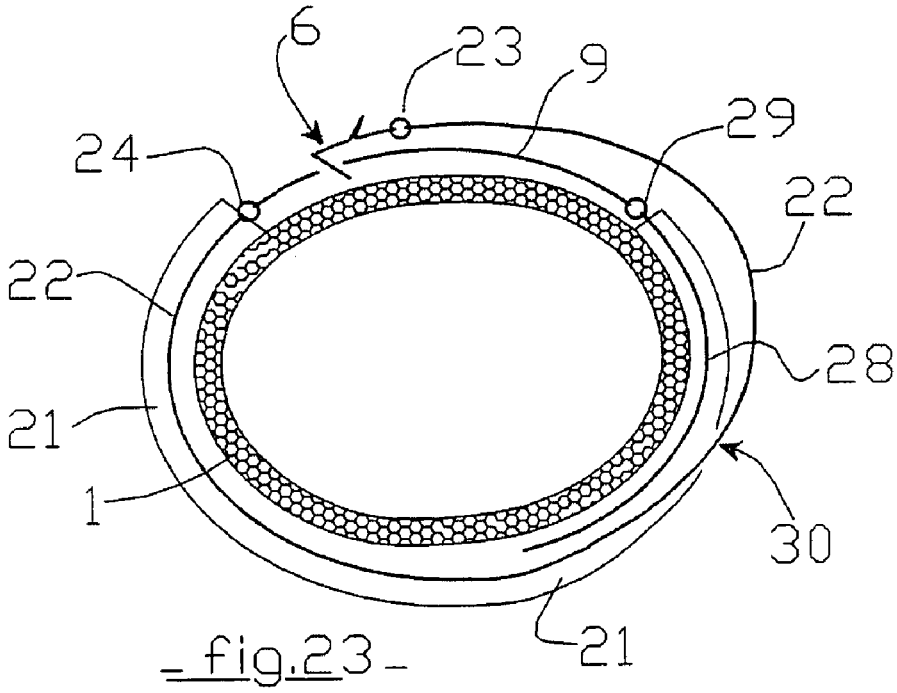
FIG. 23 is a diagrammatically cross-sectional view of the glove of FIG. 20, on the clamping device.
Figure 24:
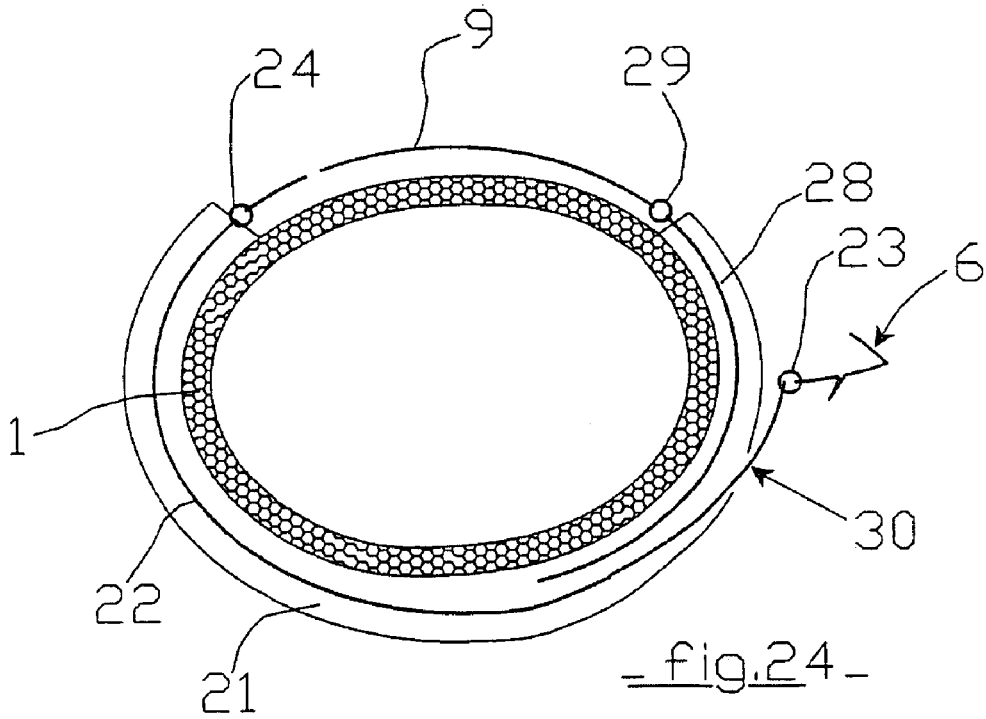
FIG. 24 is a cross-sectional view similar to that of FIG. 23, the clamping device being here represented de-activated.

The corresponding structure of the clamping device 5 is illustrated on FIGS. 23 and 24. FIG. 23 shows such clamping device in active position, the gripping member 6 being interconnected with the gripping plate 9; FIG. 24 shows it in de-activated position.

For such embodiment, the strip 22 may also be replaced with assembled metallic inserts.

The clamping device according to this invention may similarly be provided at the end of the collar 4 or over an intermediate zone of this collar.

On the other hand, on the embodiments of the FIGS. 14 to 24, the hooking member 6 may be replaced with other embodiments, in particular with the solution illustrated on FIGS. 12 and 13.

What is claimed is:

1. A protection glove made of coat of mail, i.e. formed of a latticework of interlaced metallic rings, said glove comprising:

a first portion intended to cover the hand, extended by a second portion in the form of a complete sleeve deprived of any lateral slots, intended to cover the wrist zone, said second portion being optionally extended by a collar for protecting the forearm or the arm, also in the form of a complete sleeve deprived of any lateral slots; and a clamping system on at least one of the second portion covering the wrist and the protection collar, wherein the clamping system comprises a gripping structure that is added onto said glove and a hooking member fitted with a hook or plane end return that is structured and arranged to prevent any direct gripping on the rings of the coat of mail fabric and to cooperate with at least one orifice provided in said added-on gripping structure, said hooking member is also fitted with a protruding element which constitutes a prehensile means facilitating the hooking operations on the gripping structure, as well as the releasing operations.

2. The protection glove according to claim 1, wherein the hooking member is fitted with the plane end return having a length l greater than an internal diameter of the rings of the coat of mail fabric.

3. The protection glove according to claim 1, wherein the hooking member is realized by cutting and embossing/folding a metal sheet.

4. The protection glove according to claims 1, wherein the hooking member is in the form of a plane structure fitted with the plane end return which constitutes the hook cooperating with one of the orifices of the gripping structure, said protruding element being in the form of a transversal edge provided from the upper face of said plane structure.

5. The protection glove according to claim 4, wherein the protruding element of the hooking member is in the form of a transversal edge which extends on a plane tilted with respect to the plane perpendicular to the upper face of the plane structure, for easier hooking or releasing operations.

6. The protection glove according to claim 1, wherein the hooking member is in the form of a plane structure fitted with a plane end return which constitutes the hook co-operating with one of the orifices of the gripping structure, said protruding element being in the form of a boss provided from the upper face of said plane structure, which boss is fitted with a transversal face or edge for easier handability.

7. The protection glove according to claim 1, wherein the plane end return which constitutes the hook of the hooking member comprises lateral edges slightly chamfered, convergent, which confer substantially trapezoid shape thereto.

8. The protection glove according to claim 1, wherein the gripping structure is in the form of added-on rings, imbedded in the coat of mail fabric.

9. The protection glove according to claim 1, wherein the gripping structure is in the form of a plate fitted with a plurality of orifices to enable adjustment of the clamping tension.

10. The protection glove according to claim 9, wherein the gripping plate is cambered to follow the contour of the user's wrist or arm.

11. The protection glove according to claim 9, wherein the gripping plate is several plates juxtaposed, fitted with oblong orifices arranged parallel to one another, and wherein the end hook is active over the whole length or substantially the whole length of said orifices.

12. The protection glove according to claim 1, wherein the gripping structure is in the form of several plates juxtaposed, or which overlap each other partially, each including at least one orifice, to enable adjustment of the clamping tension.

13. The protection glove according to claim 1, wherein the clamping system includes the gripping structure attached to the coat of mail fabric, and the hooking member has a rear end also attached to the coat of mail fabric, some distance away from said gripping structure for easier clamping on the corresponding glove zone.

14. The protection glove according to claim 1, wherein the clamping system includes the gripping structure attached to the coat of mail fabric, and the hooking member has a rear end attached to the coat of mail fabric by means of an insert, or of several inserts connected to one another.

15. The protection glove according to claim 1, wherein the clamping system is composed of a single-piece strip hugging the corresponding glove zone, whereof one of the ends thereof is formed to provide the hooking member, and whereof the other end is formed to provide the gripping structure.

16. The protection glove according to claim 15, further comprising at least one loop for holding the strap on the corresponding glove zone.

17. The protection glove comprising a sleeve made of coat of mail that houses at least one portion of the strap.

18. The protection glove according to claim 17, wherein the clamping system is fitted with an additional plate attached at the end of the gripping structure by a hinged link, said additional plate is housed in the reception sleeve of the strap.

19. The protection glove according to claim 18, wherein the reception sleeve of the strap extends from each of the ends of the gripping structure, said reception sleeve comprises an exit slot for the end of said strap fitted with the hooking member.

20. The protection glove according to claim 15, wherein the gripping structure is in the form of a plate attached to the coat of mail fabric by means of linking rings.

21. The protection glove according to claim 1, wherein the clamping system is composed of the hooking member and of the gripping structure, attached to the ends of an added-on strap, in the form of a strip or of a series of inserts.

* * * * *